US010888985B2

(12) United States Patent
Ryan et al.

(10) Patent No.: US 10,888,985 B2
(45) Date of Patent: Jan. 12, 2021

(54) FASTENER PUSHER WITH AN IMPROVED WORKPIECE-CONTACT ELEMENT

(71) Applicant: Illinois Tool Works Inc., Glenview, IL (US)

(72) Inventors: Patrick Ryan, Arlington Heights, IL (US); Genaro Cortez, Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 375 days.

(21) Appl. No.: 15/439,734

(22) Filed: Feb. 22, 2017

(65) Prior Publication Data

US 2018/0236647 A1 Aug. 23, 2018

(51) Int. Cl.

| | |
|---|---|
| ***B25C 7/00*** | (2006.01) |
| ***B25C 1/00*** | (2006.01) |
| ***B25C 1/04*** | (2006.01) |
| ***B25C 1/18*** | (2006.01) |

(52) U.S. Cl.

CPC ..... *B25C 7/00* (2013.01); *B25C 1/003* (2013.01); *B25C 1/008* (2013.01); *B25C 1/047* (2013.01); *B25C 1/188* (2013.01)

(58) Field of Classification Search

CPC ..... B25C 7/00; B25C 1/003; B25C 1/047; B25C 1/188

USPC ..... 227/120, 140

See application file for complete search history.

(56) References Cited

U.S. PATENT DOCUMENTS

| | | | | | |
|---|---|---|---|---|---|
| 347,482 | A * | 8/1886 | Glidden | A43D 79/00 | 227/140 |
| 480,031 | A * | 8/1892 | Platt | B27F 7/02 | 227/20 |
| 2,449,860 | A * | 9/1948 | Raybourd | B25C 1/00 | 227/118 |
| 2,918,675 | A * | 12/1959 | Smith | B25C 7/00 | 173/127 |
| 3,040,327 | A * | 6/1962 | Michel | B25C 7/00 | 227/66 |
| 3,249,279 | A * | 5/1966 | Behrend | B25C 1/188 | 227/10 |

(Continued)

FOREIGN PATENT DOCUMENTS

| | | |
|---|---|---|
| EP | 0 774 325 | 5/1997 |
| EP | 1 621 291 | 2/2006 |

OTHER PUBLICATIONS

Australian Examination Report No. 1 for Australian Application No. 2017201288, dated Feb. 16, 2018 (7 pages).

(Continued)

*Primary Examiner* — Thanh K Truong
*Assistant Examiner* — Scott A Howell
(74) *Attorney, Agent, or Firm* — Neal, Gerber & Eisenberg LLP

(57) ABSTRACT

Various embodiments of the present disclosure provide a workpiece-contact element for a fastener pusher. In one embodiment, the workpiece-contact element includes an attachment side, a workpiece-contact surface, and one or more fastener-exit surfaces defining a fastener-exit through-bore having a longitudinal axis and extending through the workpiece-contact surface. The workpiece-contact surface forms an annular protrusion extending away from the attachment side.

19 Claims, 15 Drawing Sheets

(56) References Cited

U.S. PATENT DOCUMENTS 3,521,398 A * 7/1970 Coutts ..... B25C 3/006 227/149
3,559,449 A * 2/1971 Steinmetz ..... B21J 15/185 72/430
3,566,978 A * 3/1971 Udert ..... B25C 1/14 173/211
3,774,293 A * 11/1973 Golsch ..... B25C 1/008 227/130
4,179,058 A * 12/1979 Yost ..... B25C 3/002 227/147
4,195,762 A * 4/1980 Burton ..... A47C 31/026 227/149
4,252,260 A * 2/1981 Burton ..... B25C 1/00 227/119
4,341,336 A * 7/1982 Smith ..... B25C 1/047 227/130
4,530,455 A * 7/1985 Vornberger ..... F16J 1/12 173/127
4,610,381 A * 9/1986 Kramer ..... B25C 1/005 227/120
4,778,094 A * 10/1988 Fishback ..... B25C 1/047 227/120
5,052,607 A * 10/1991 Dutton ..... B25C 7/00 227/107
5,205,457 A * 4/1993 Blomquist, Jr. ..... B25C 1/188 227/130
5,267,682 A * 12/1993 Okouchi ..... E04D 15/02 227/120
5,320,268 A * 6/1994 Shkolnikov ..... B25C 7/00 227/148
5,628,445 A * 5/1997 Braddock ..... B25C 7/00 227/120
5,649,661 A * 7/1997 Masuno ..... B25C 1/003 227/156
5,683,217 A 11/1997 Walther et al.
5,810,239 A * 9/1998 Stich ..... B25C 7/00 227/119
6,279,808 B1 * 8/2001 Larsen ..... B25C 1/00 227/119
6,286,742 B1 * 9/2001 Mukoyama ..... B25C 1/00 227/148
6,318,617 B1 * 11/2001 Cheng ..... B25C 5/06 227/109
6,431,428 B1 8/2002 Chen
6,578,749 B1 * 6/2003 Shen ..... B25C 1/003 227/119
6,676,001 B1 * 1/2004 Chen ..... B25B 23/045 227/119
7,017,790 B1 * 3/2006 Peng ..... B25C 1/188 227/107
7,070,079 B2 * 7/2006 Smolinski ..... B25C 7/00 227/142
7,484,578 B2 * 2/2009 Duncan ..... E21B 10/02 175/402
8,025,467 B2 * 9/2011 Astorga Ramirez ..... B23B 49/008 408/10
8,056,785 B2 * 11/2011 Gosis ..... B25C 7/00 227/140
8,220,687 B2 * 7/2012 Yamamoto ..... B25C 1/008 227/120
8,678,262 B2 * 3/2014 Zhou ..... B25C 1/06 227/113
10,307,903 B2 * 6/2019 Reed ..... E04F 21/1855
2006/0196682 A1 * 9/2006 McGee ..... B25C 1/041 173/1
2009/0095786 A1 4/2009 Gosis et al.
2011/0297727 A1 * 12/2011 Herelier ..... B25C 1/188 227/139
2011/0297728 A1 * 12/2011 Liang ..... B25C 7/00 227/142
2018/0154505 A1 * 6/2018 Sato ..... B25C 1/008

OTHER PUBLICATIONS

Toolmatic® Automated Fastening Systems brochure, by ITW Industry, Nov. 2010 (32 pages).
International Search and Written Opinion for International Application No. PCT/US2018/017060, dated May 15, 2018 (12 pages).

* cited by examiner

FASTENER PUSHER WITH AN IMPROVED WORKPIECE-CONTACT ELEMENT

BACKGROUND

The present disclosure relates to fastener pushers, and more particularly to a fastener pusher with an improved workpiece-contact element.

A typical fastener pusher includes a body, a head supported by and movable relative to the body between a resting position and a driving position, and a nosepiece fixedly attached to the head. The head defines an internal cavity that at least partially houses a cylinder. A piston carrying a driving element including a driver blade is slidably disposed in the cylinder and movable relative to the cylinder between a pre-firing position and a firing position. The nosepiece defines a fastener-receiving channel. The end of the nosepiece opposite the end attached to the head includes a workpiece-contact element that includes a flat workpiece-contact surface. The nosepiece defines a drive channel that intersects the fastener-receiving channel and that extends through the workpiece-contact element.

A fastener pusher drives a fastener to attach one workpiece to another. To attach a first workpiece to a second workpiece, a fastener received from a magazine is introduced through the fastener-receiving channel and into the drive channel via suitable biasing elements, as known in the art. The fastener pusher then moves the head relative to the body from the resting position to the driving position. This causes the flat workpiece-contact surface of the workpiece-contact element of the nosepiece to contact the first workpiece with enough force to clamp the first workpiece and the second workpiece between the workpiece-contact element and the surface on which the second workpiece is resting. This reduces and in some cases eliminates any space between the workpieces caused by, for instance, a bowed, cupped, or twisted workpiece.

The fastener pusher then uses compressed air (as is known in the art) to drive the driving assembly through the cylinder from the pre-firing position to the firing position. As the driving assembly moves to the firing position, the driver blade travels through the drive channel. The drive channel guides the driver blade to contact the fastener housed in the drive channel. Continued movement of the driving assembly through the cylinder toward the firing position forces the driver blade to drive the fastener from the nosepiece into the first workpiece to attach the first workpiece to the second workpiece. The driving assembly is then forced back to the pre-firing position.

Fastener pushers are commonly used to attach gypsum board or drywall to a substrate, such as lumber. The exterior surface of the gypsum board is generally flat and lies in an exterior plane. When a fastener is used to attach the gypsum board to the substrate, the head of the fastener should be recessed below the exterior plane and into the gypsum board. The space between the recessed head and the exterior plane is later filled with joint compound and sanded to provide a smooth finished exterior surface.

Known fastener pushers with workpiece-contact elements having flat workpiece-contact surfaces can't consistently recess the fastener heads without damaging the gypsum board. Using relatively high-pressure air to drive the driving element ensures a recessed fastener head, but can damage the gypsum board beyond repair, such as by tearing the outer paper. It could also drive the fastener too far into the gypsum board, compromising the integrity of the attachment. FIG. 1A shows an example fastener (not labeled) driven into gypsum board 1000 to attach the gypsum board 1000 into lumber 2000. Here, the fastener head is recessed below the exterior plane 3000 in which the exterior surface 1000*a* of the gypsum board 1000 lies, but the gypsum board 1000 is damaged and the fastener was driven too far.

Conversely, while using relatively low-pressure air to drive the driving element reduces the likelihood of damaging the gypsum board or drywall, it doesn't consistently recess fastener heads. FIG. 1B shows an example fastener (not labeled) driven into the gypsum board 1000 to attach the gypsum board 1000 into the lumber 2000. Here, the fastener head is not recessed below the exterior plane 3000.

A happy medium that consistently recesses fastener heads without damaging the gypsum board or drywall doesn't exist.

This inconsistency wastes material. Gypsum board or drywall damaged beyond repair due to high-pressure fastener driving must be thrown away. This inconsistency also increases downtime. Work must be stopped to identify and replace damaged gypsum board or drywall. Work must also be stopped to identify fasteners without recessed heads due to low-pressure fastener driving and to manually recess them. These problems exponentially worsen in a high-throughput, automated manufacturing plant that uses tens or hundreds of fastener pushers to automate attaching gypsum board or drywall to a substrate, such as to create prefabricated wall panels. Stopping the assembly line several times per day (or even per hour) to replace a sheet of damaged gypsum board or drywall or to recess non-recessed fastener heads introduces costly delays.

SUMMARY

Various embodiments of the present disclosure provide a fastener pusher with an improved workpiece-contact element. In one embodiment, the workpiece-contact element includes an attachment side, a workpiece-contact surface, and one or more fastener-exit surfaces defining a fastener-exit throughbore having a longitudinal axis and extending through the workpiece-contact surface. The workpiece-contact surface forms an annular protrusion extending away from the attachment side.

The workpiece-contact element solves the above-described problems by providing a fastener pusher that consistently recesses fastener heads without damaging the gypsum board. The annular protrusion of the workpiece-contact element creates a depressed area in the gypsum board during fastener driving. The bottom of this depressed area is below the exterior plane formed by the exterior surface of the non-depressed areas of the gypsum board. This means that the fastener head can protrude from the exterior surface of the depressed area of the gypsum board and still be recessed below the exterior plane. The fastener pusher can therefore use relatively low-pressure air to drive the driving element, which minimizes damage to the gypsum board.

Other objects, features, and advantages of the present disclosure will be apparent from the detailed description and the drawings.

DETAILED DESCRIPTION

Figure 1A:
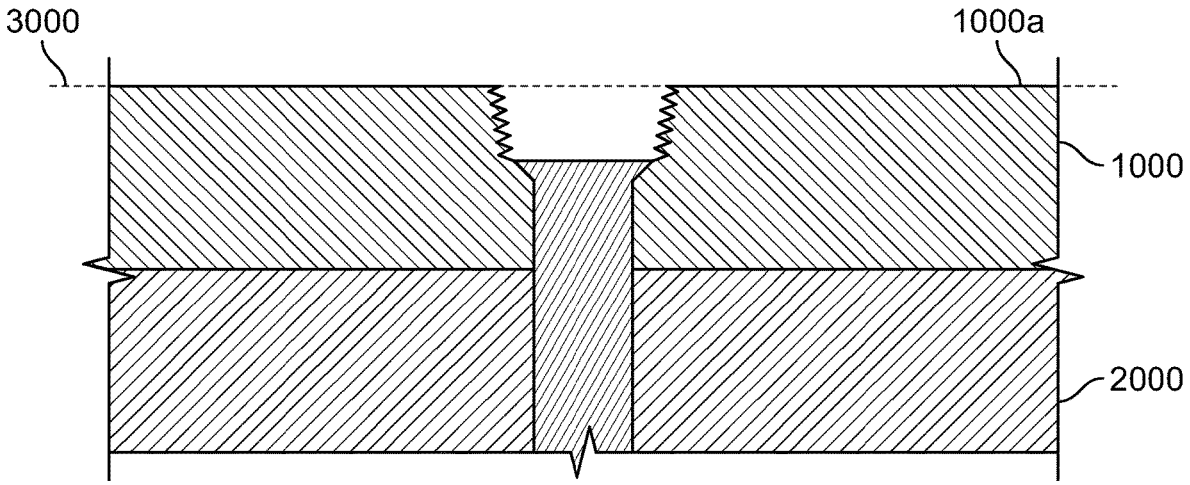
FIG. 1A (Prior Art)
FIG. 1A is a cross-sectional-front-elevational view of a fastener driven into gypsum board to attach the gypsum board to lumber using a prior art fastener pusher.
Figure 1B:
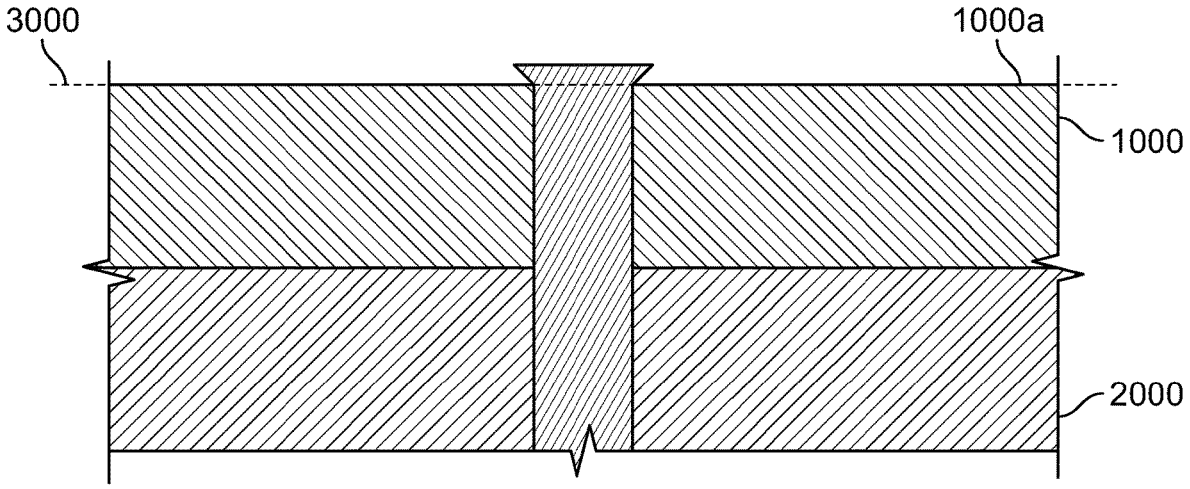
FIG. 1B (Prior Art)
FIG. 1B is a cross-sectional-front-elevational view of a fastener driven into gypsum board to attach the gypsum board to lumber using another prior art fastener pusher.
Figure 2:
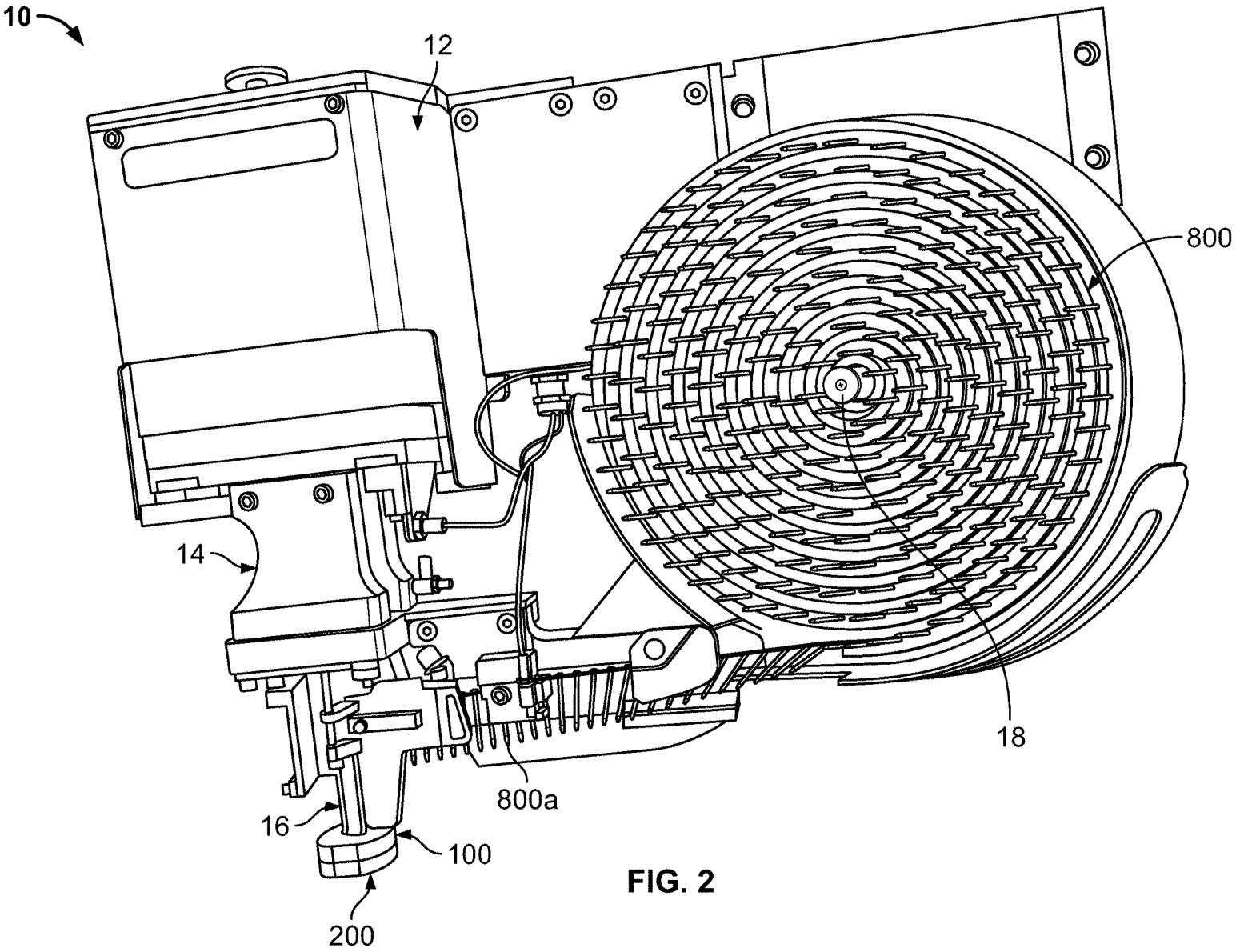
FIG. 2 is a perspective view of a fastener pusher of one embodiment of the present disclosure.
Figure 3:
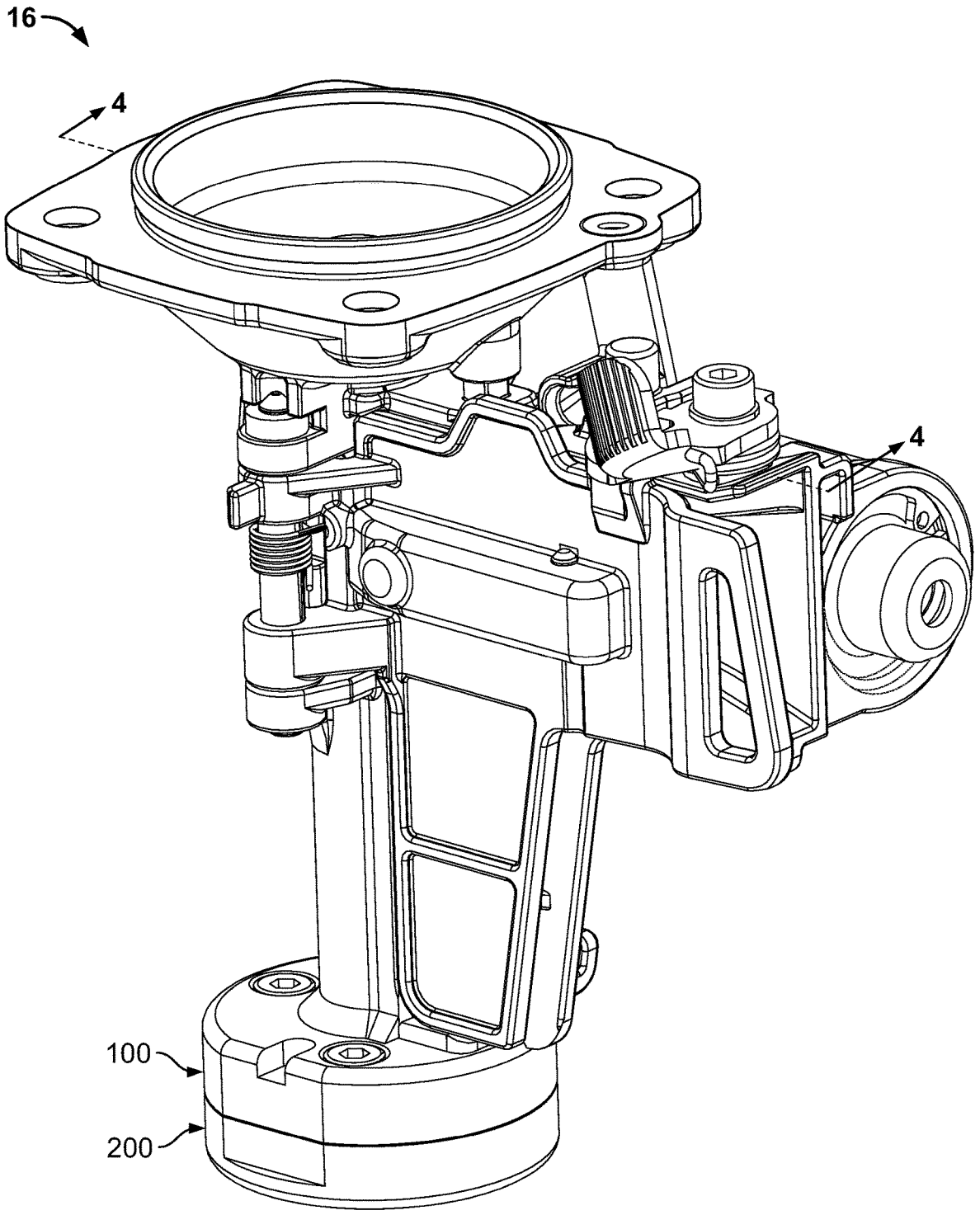
FIG. 3 is a perspective view of the nosepiece, the workpiece-contact element, and the fastener-stabilizing assembly of the fastener pusher of FIG. 3.

Various embodiments of the present disclosure provide a fastener pusher with a workpiece-contact element that solves the above problems. FIGS. 2-8 show one example embodiment of the fastener pusher 10 of the present disclosure and some of its components. As best shown in FIGS. 2-5, the fastener pusher 10 includes: (1) a body 12; (2) a head 14 supported by and movable relative to the body 12 between a resting position and a driving position; (3) a nosepiece 16 fixedly attached to the head 14 and including a workpiece-contact element mount 100; (4) a workpiece-contact element 200 attached to the workpiece-contact element mount 100; (5) a fastener-stabilizing assembly 400 mounted within the workpiece-contact element 200; and (6) a rotatable spindle 18 supported by the body 12.

Figure 4:
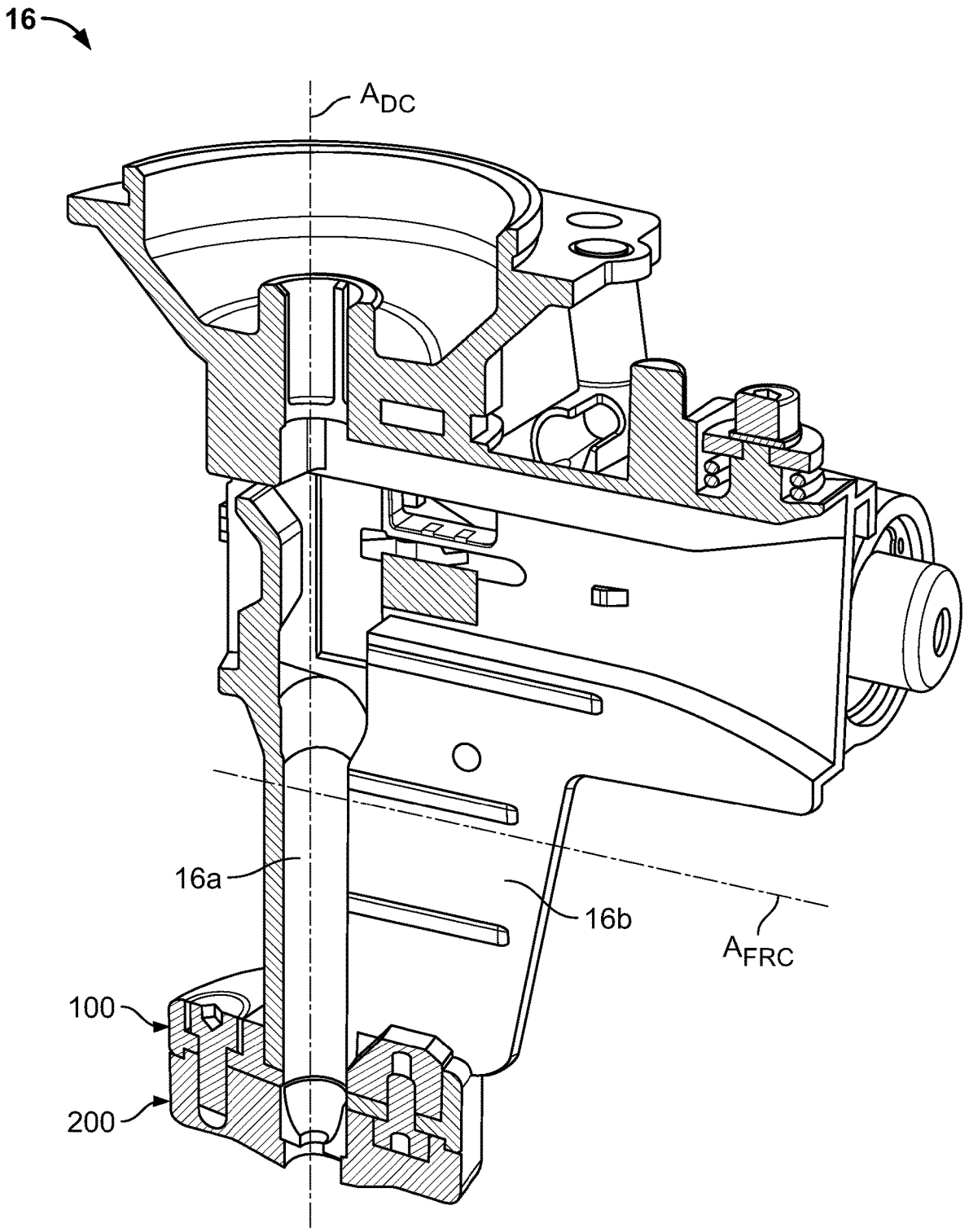
FIG. 4 is a cross-sectional-perspective view of the nosepiece, the workpiece-contact element, and the fastener-stabilizing assembly of FIG. 3 taken substantially along line 4-4 of FIG. 3.

The head 14 defines an internal cavity (not shown) that at least partially houses a cylinder (not shown). A piston (not shown) carrying a driving element (not shown) including a driver blade (shown in FIG. 9C) is slidably disposed in the cylinder and movable relative to the cylinder between a pre-firing position and a firing position. The nosepiece 16 defines a drive channel 16*a* having a longitudinal axis $A_{DC}$ and a fastener-receiving channel 16*b* having a longitudinal axis $A_{FRI}$. The fastener-receiving channel 16*b* intersects the drive channel 16*a* such that, in this example embodiment, their longitudinal axes are perpendicular (or in other embodiments transverse), as best shown in FIG. 4. A collation 800 of fasteners 800*a*, which are nails in this example embodiment, is mounted on the spindle 18. A leading end of the collation 800 of fasteners 800*a* extends into the fastener-receiving channel 16*b* generally along the longitudinal axis $A_{FRC}$ such that the fastener 800*aa* at the leading end of the collation 800 is positioned within the drive channel 16*a*.

Generally, to attach a first workpiece to a second workpiece using the fastener pusher 10, the fastener pusher 10 moves the head 14 relative to the body 12 from the resting position to the driving position. This causes the workpiece-contact element 200 attached to the nosepiece 100 to contact the first workpiece with enough force to clamp the first workpiece and the second workpiece between the workpiece-contact element and the surface on which the second workpiece is resting.

The fastener pusher 10 then uses compressed air (as is known in the art) to drive the driving assembly through the cylinder from the pre-firing position to the firing position. As the driving assembly moves to the firing position, the driver blade travels through the drive channel 16*a* along the longitudinal axis $A_{DC}$. The drive channel 16*a* guides the driver blade to contact the fastener 800*aa* housed in the drive channel 16*a*. Continued movement of the driving assembly through the cylinder toward the firing position forces the driver blade to drive the fastener 800*aa* from the nosepiece 16 through the workpiece-contact element 200 and into the first workpiece to attach the first workpiece to the second workpiece. This process is described in more detail below with respect to FIGS. 9A-9D.

FIGS. 6A-6G show the workpiece-contact element 200. The workpiece-contact element 200 generally includes an attachment side and a workpiece side. The attachment side is adjacent to and contacts the nosepiece 16 when the workpiece-contact element 200 is attached to the nosepiece 16. The workpiece side is free when the workpiece-contact element 200 is attached to the nosepiece 16. The workpiece-contact element has a longitudinal axis $A_{WCE}$ that extends from the attachment side to the workpiece side. The longitudinal axis $A_{WCE}$ is coaxial with the longitudinal axis $A_{DC}$ of the drive channel 16*a*.

More specifically, the workpiece-contact element 200 includes: (1) a circular mounting surface 202 centered on and perpendicular (or in other embodiments transverse) to the longitudinal axis $A_{WCE}$; (2) a cylindrical standoff surface 204 centered on and parallel to the longitudinal axis $A_{WCE}$;

(3) an annular surface 206 centered on and perpendicular (or in other embodiments transverse) to the longitudinal axis $A_{WCE}$; (4) a cylindrical side surface 208 centered on and parallel to the longitudinal axis $A_{WCE}$; and (5) a workpiece-contact surface 210 centered on the longitudinal axis $A_{WCE}$. The standoff surface 204 connects the outer circular edge of the mounting surface 202 and the inner circular edge of the annular surface 206. The side surface 208 connects the outer circular edge of the annular surface 206 and the outer circular edge of the workpiece-contact surface 210.

In this example embodiment, the workpiece-contact element is a single-piece component machined from a solid body (though the workpiece-contact element could be fabricated in any suitable manner, such as via casting or 3-D printing). In other embodiments, the workpiece-contact element is made of multiple components attached to one another in a suitable manner (such as two halves attached via fasteners or welding). The workpiece-contact element may be made of any suitable material, such as hardened steel.

Figure 6A:
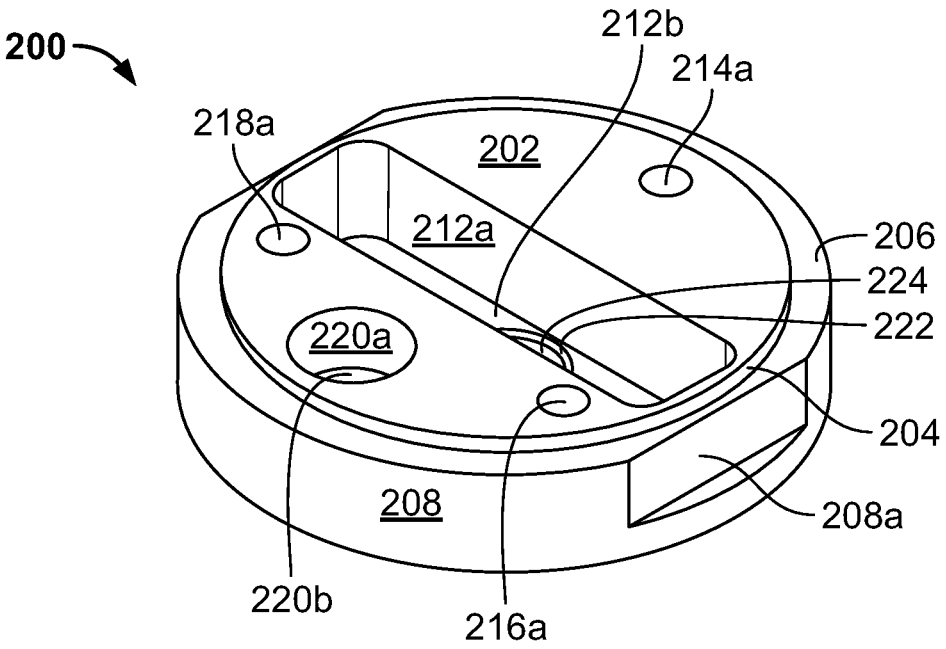
FIG. 6A is a top-perspective view of the workpiece-contact element of FIGS. 2-5.
Figure 6B:
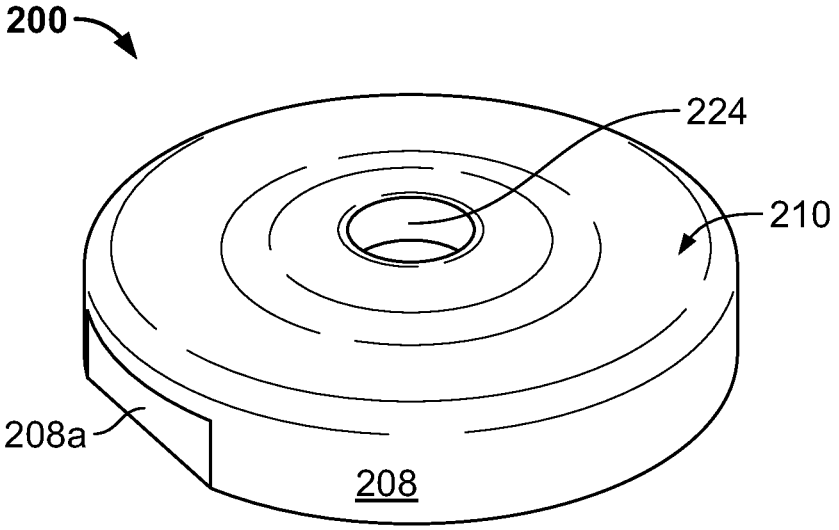
FIG. 6B is a bottom-perspective view of the workpiece-contact element of FIG. 6A.
Figure 6C:
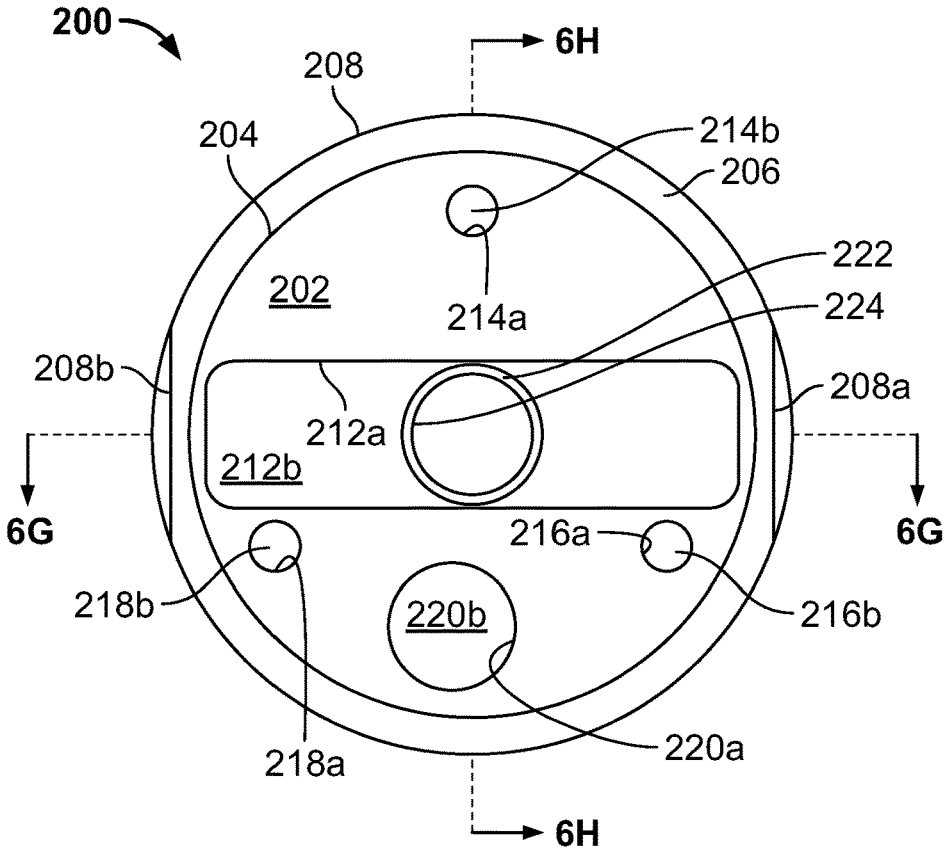
FIG. 6C is a top-plan-view of the workpiece-contact element of FIG. 6A.
Figure 6D:
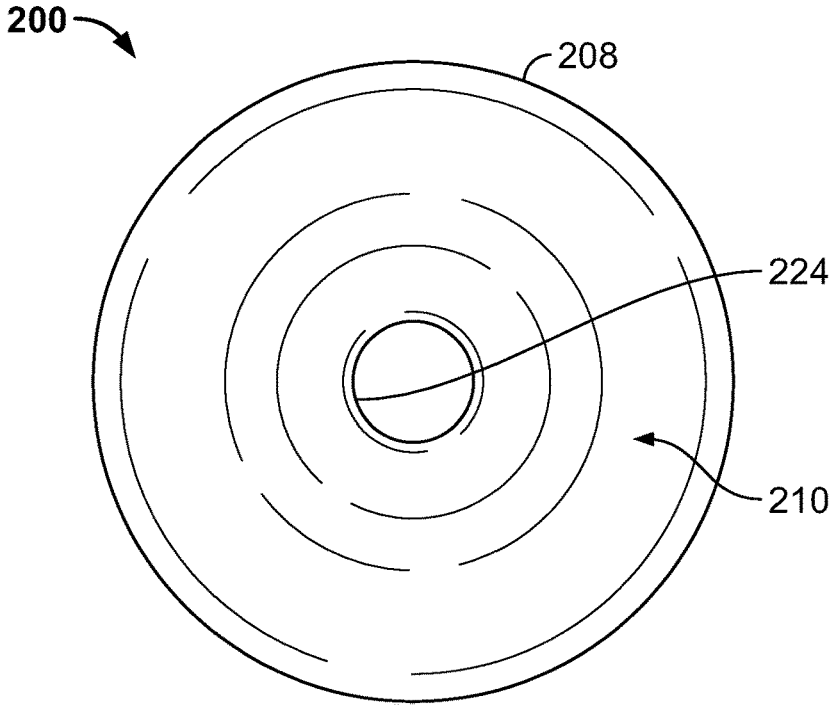
FIG. 6D is a bottom-plan view of the workpiece-contact element of FIG. 6A.
Figure 6E:
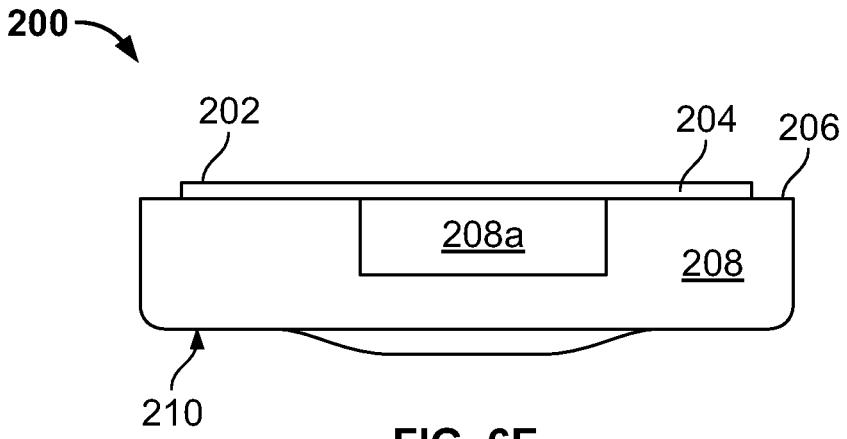
FIG. 6E is a right-side-elevational view of the workpiece-contact element of FIG. 6A.
Figure 6F:
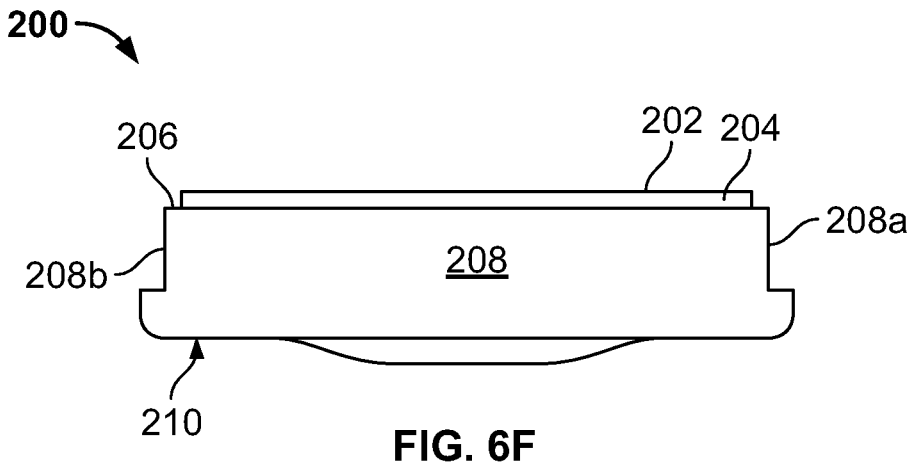
FIG. 6F is a front-side-elevational view of the workpiece-contact element of FIG. 6A.
Figure 6G:
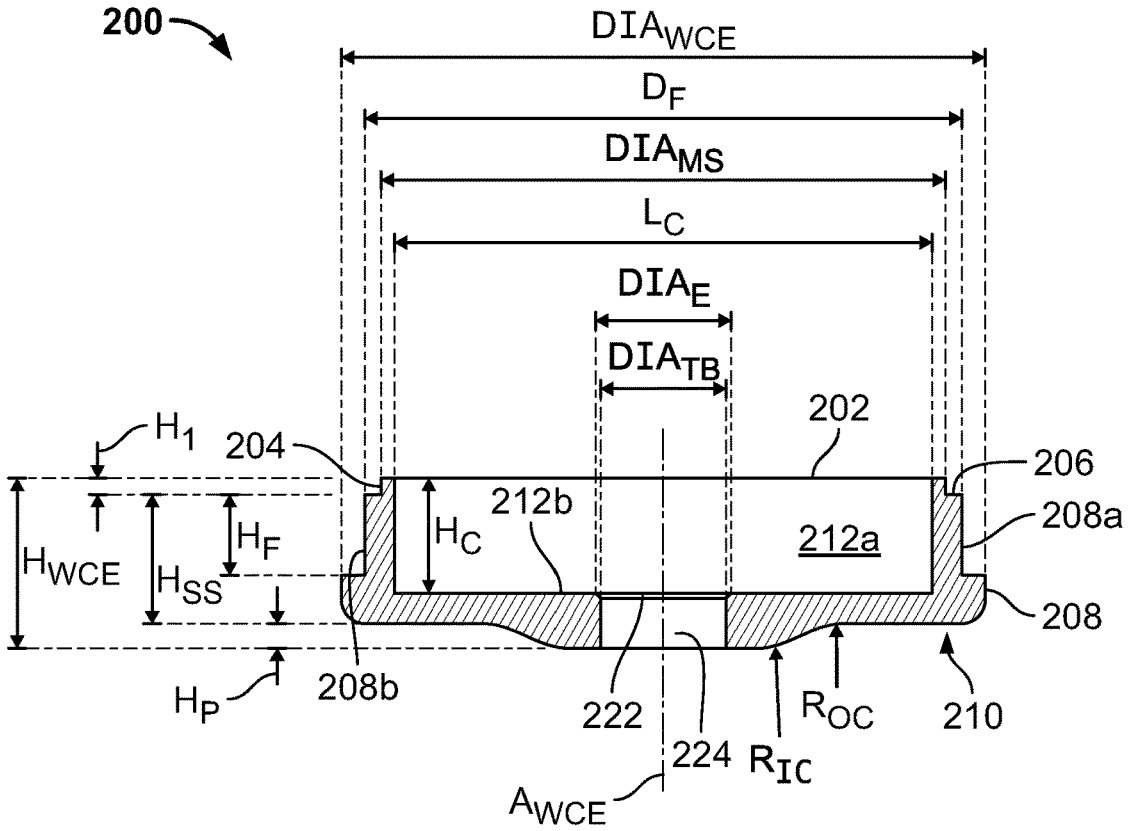
FIG. 6G is a cross-sectional-front-side-elevational view of the workpiece-contact element of FIG. 6A taken substantially along line 6G-6G of FIG. 6C.

In this example embodiment and as shown in FIG. 6G, the mounting surface 202 has an outer diameter $DIA_{MS}$, which in this example embodiment is 35 millimeters +/−0.005 millimeters (though it may be any suitable value in other embodiments).

In this example embodiment and as shown in FIG. 6G, the standoff surface 204 has an outer diameter $DIA_{MS}$, which in this example embodiment is 35 millimeters (though it may be any suitable value in other embodiments), and a height $H_1$, which in this example embodiment is 1 millimeter +/−0.010 millimeters (though it may be any suitable value in other embodiments).

Figure 6H:
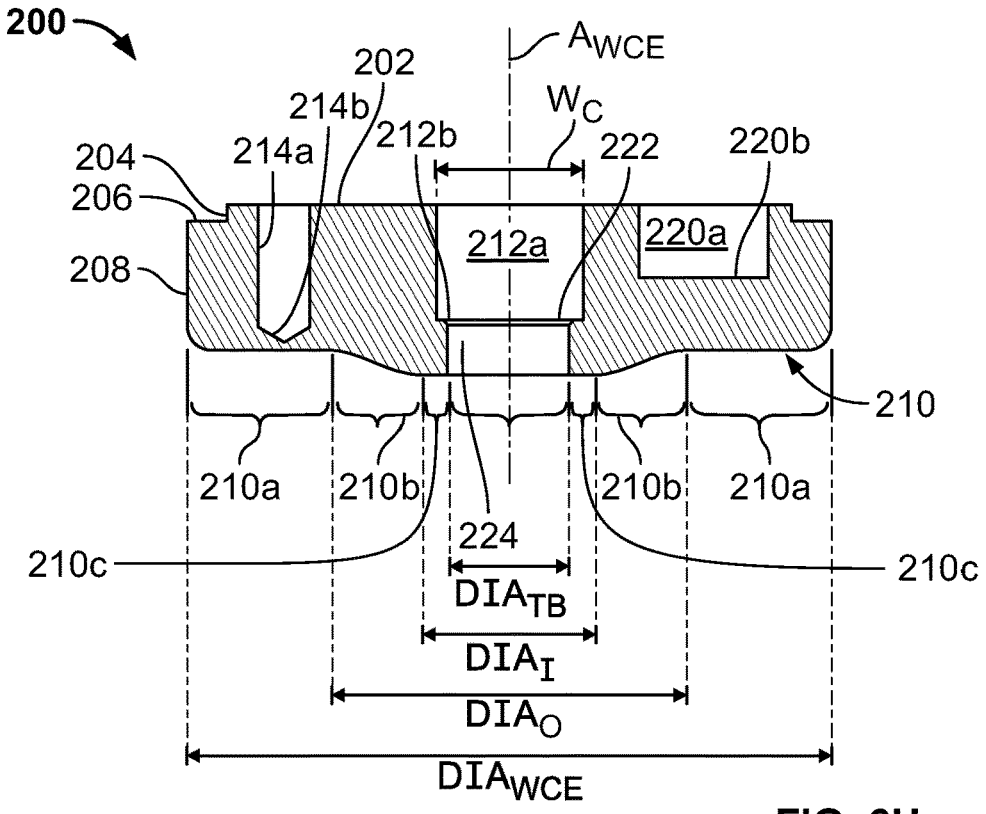
FIG. 6H is a cross-sectional-right-side-elevational view of the workpiece-contact element of FIG. 6A taken substantially along line 6H-6H of FIG. 6C.

In this example embodiment and as shown in FIGS. 6G and 6H, the side surface 208 (and thus the workpiece-contact element 200) has an outer diameter $DIA_{WCE}$, which in this example embodiment is 40 millimeters (though it may be any suitable value in other embodiments). The side surface 208 also has a height $H_{SS}$, which in this example embodiment is 8 millimeters (though it may be any suitable value in other embodiments). The side surface 208 defines two opposing flat (or in other embodiments at least partially curved) surfaces 208*a* and 208*b* positioned to facilitate mounting the workpiece-contact element 200 to the nosepiece 16, as described below. The flat surfaces 208*a* and 208*b* are parallel to the longitudinal axis $A_{WCE}$ and are separated by a distance $D_F$, which in this example embodiment is 37 millimeters (though it may be any suitable value in other embodiments). Each of the flat surfaces 208*a* and 208*b* has a height $H_F$, which in this example embodiment is 5 millimeters +/−0.010 millimeters (though it may be any suitable value in other embodiments).

The workpiece-contact surface 210 extends away from the attachment side, and in this embodiment the mounting surface 202, near the longitudinal axis $A_{WCE}$ to form a protrusion. More specifically, as shown in FIG. 6H, the workpiece-contact surface 210 includes: (1) a flat first annular section 210*a* perpendicular (or in other embodiments transverse) to the longitudinal axis $A_{WCE}$; (2) a second annular section connected to the first annular section 210*a* and extending from the first annular section 210*a* toward the longitudinal axis $A_{WCE}$ and away from the mounting surface 202; and (3) a flat third annular section 210*c* connected to the second annular section 210*b* and perpendicular (or in other embodiments transverse) to the longitudinal axis $A_{WCE}$.

In this example embodiment, the second annular section includes an annular concave (i.e., inwardly curved) portion connected to the first annular section 210*a* that transitions into an annular convex (i.e., outwardly curved) portion connected to the third annular section 210*c*. In this example embodiment and as shown in FIG. 6G, the annular concave portion is curved at a 10.83 millimeter radius +/−0.10 millimeters (though it may be any suitable value in other embodiments) and the annular convex portion is curved at an 8 millimeter radius +/−0.10 millimeters (though it may be any suitable value in other embodiments). In another embodiment, the concave portion transitions into a flat portion (angled less than 90 degrees relative to the longitudinal axis $A_{WCE}$) that in turn transitions into the convex portion. In further embodiments, the second annular section doesn't include concave and/or convex portions. In one embodiment, the second annular section is flat and is angled less than 90 degrees relative to the longitudinal axis $A_{WCE}$.

In this example embodiment and as shown in FIG. 6G, the protrusion is offset from the first annular section 210*a* by a height $H_P$, which is 1.5 millimeters +/−0.010 millimeters in this example embodiment (though it may be any suitable value in other embodiments). The height of the workpiece-contact element 200, designated $H_{WCE}$, is therefore 10.5 millimeters +/−0.010 millimeters in this example embodiment (though it may be any suitable value in other embodiments). Additionally, the outer diameter of the second annular section $D_O$ (along its edge that connects to the inner edge of the first annular section) is 20 millimeters +/−0.010 millimeters (though it may be any suitable value in other embodiments) and the inner diameter of the second annular section $D_I$ (along its edge that connects to the outer edge of the third annular section) is 14.4 millimeters +/−0.010 millimeters (though it may be any suitable value in other embodiments).

The workpiece-contact element 200 includes a fastener-stabilizing-assembly-receiving-cavity side wall 212*a* and a fastener-stabilizing-assembly-receiving-cavity bottom wall 212*b* that together define a fastener-stabilizing-assembly-receiving cavity sized to house the fastener-stabilizing assembly 400, as described below. In this example embodiment and as shown in FIGS. 6G and 6H, the fastener-stabilizing-receiving cavity has a length $L_C$, a width $W_C$, and a height $H_C$. In this example embodiment, the length $L_C$ is 33.4 millimeters +/−0.010 millimeters (though it may be any suitable value in other embodiments), the width $W_C$ is 9.1 millimeters +/−0.010 millimeters (though it may be any suitable value in other embodiments), and the height $H_C$ is 7.1 millimeters +/−0.010 millimeters (though it may be any suitable value in other embodiments).

The workpiece-contact element 200 includes (at least partially) threaded cylindrical surfaces 214*a*, 216*a*, and 218*a* and corresponding radially inwardly tapered bottom surfaces 214*b*, 216*b*, and 218*b*. These pairs of threaded cylindrical and bottom surfaces define threaded fastener-receiving openings sized to respectively receive fasteners 300*a*, 300*b*, and 300*c* to attach the workpiece-contact element 200 to the nosepiece 16, as described below. The threaded fastener-receiving openings are evenly circumferentially spaced around the longitudinal axis $A_{WCE}$.

Figure 8:
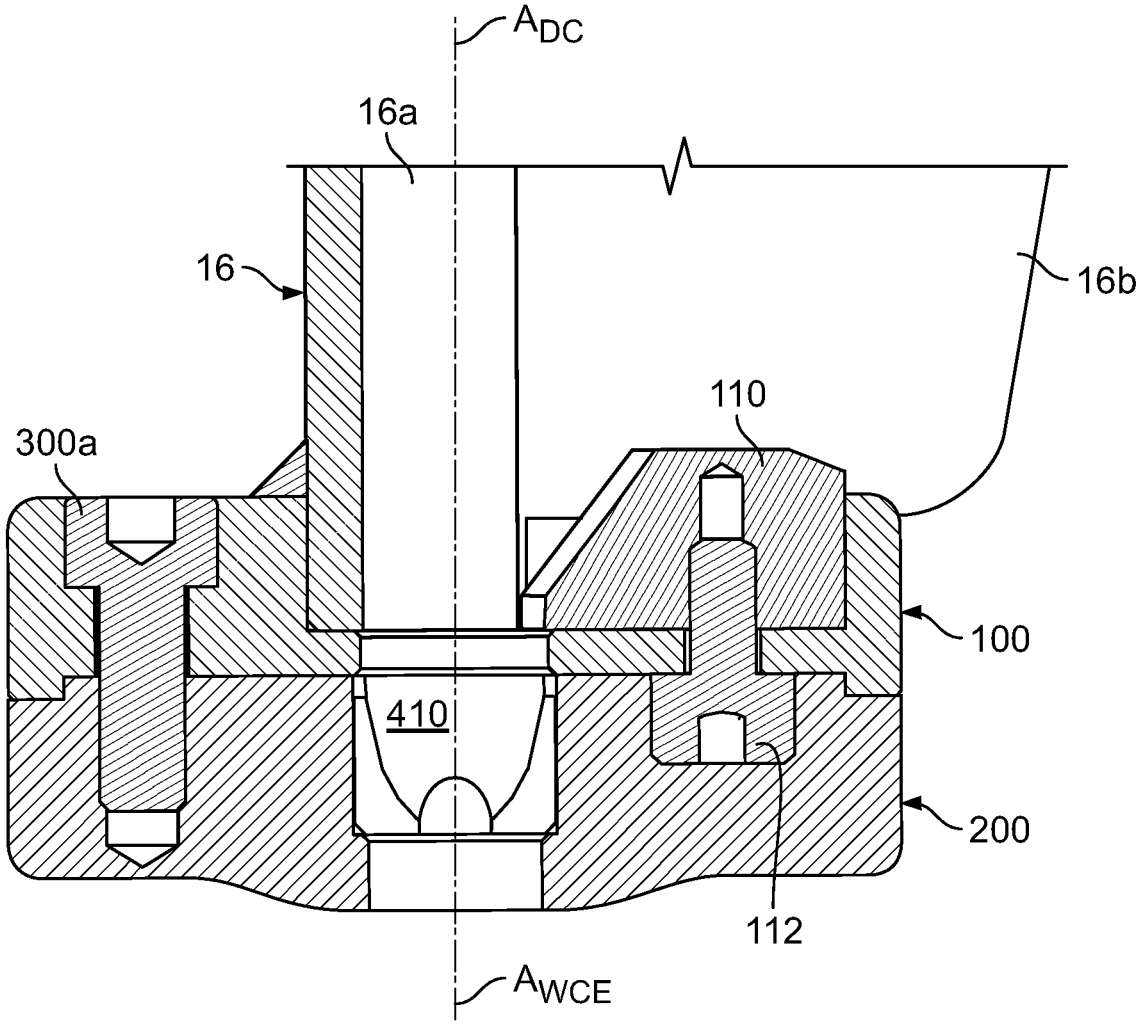
FIG. 8 is a fragmentary cross-sectional-right-side-elevational view of the assembled nozzle, fastener-stabilizing assembly, and workpiece-contact element of FIGS. 2-5 taken substantially along line 6H-6H of FIG. 6C.

The workpiece-contact element 200 includes a cylindrical surface 220*a* and a flat (or in other embodiments at least partially curved) circular bottom surface 220*b* that define a fastener-head-receiving opening sized to receive the head of a fastener 112 that secures a fastener-directing element 110 to the workpiece-contact mount 100, as shown in FIG. 8.

The workpiece-contact element 200 includes a flat (or in other embodiments at least partially curved) annular surface 222 centered on and angled less than 90 degrees relative to the longitudinal axis $A_{WCE}$. The workpiece-contact element 200 also includes a cylindrical surface 224 centered on and parallel to the longitudinal axis $A_{WCE}$. The annular surface 222 and the cylindrical surface 224 together define a fastener-exit throughbore that extends from the fastener-stabilizing-assembly-receiving cavity to the workpiece-contact surface 210 through which fasteners 800*a* driven from the drive channel 16*a* exit the workpiece-contact element 200. In this example embodiment, the longitudinal axis of the fastener-exit throughbore is coaxial with the longitudinal axis $A_{WCE}$, and thus also coaxial with the longitudinal axis $A_{DC}$ of the drive channel 16*a*. In other embodiments, the longitudinal axis of the fastener-exit throughbore is coaxial with $A_{DC}$ but not with $A_{WCE}$. In this example embodiment and as shown in FIGS. 6G and 6H, the annular surface 222 has an outer diameter $D_E$, which is 9 millimeters +/−0.010 millimeters in this example embodiment (though it may be any suitable value in other embodiments). Additionally, the cylindrical surface 224 has a diameter $D_{TB}$, which is 7.8 millimeters +/−0.010 millimeters in this example embodiment (though it may be any suitable value in other embodiments).

Figure 5:
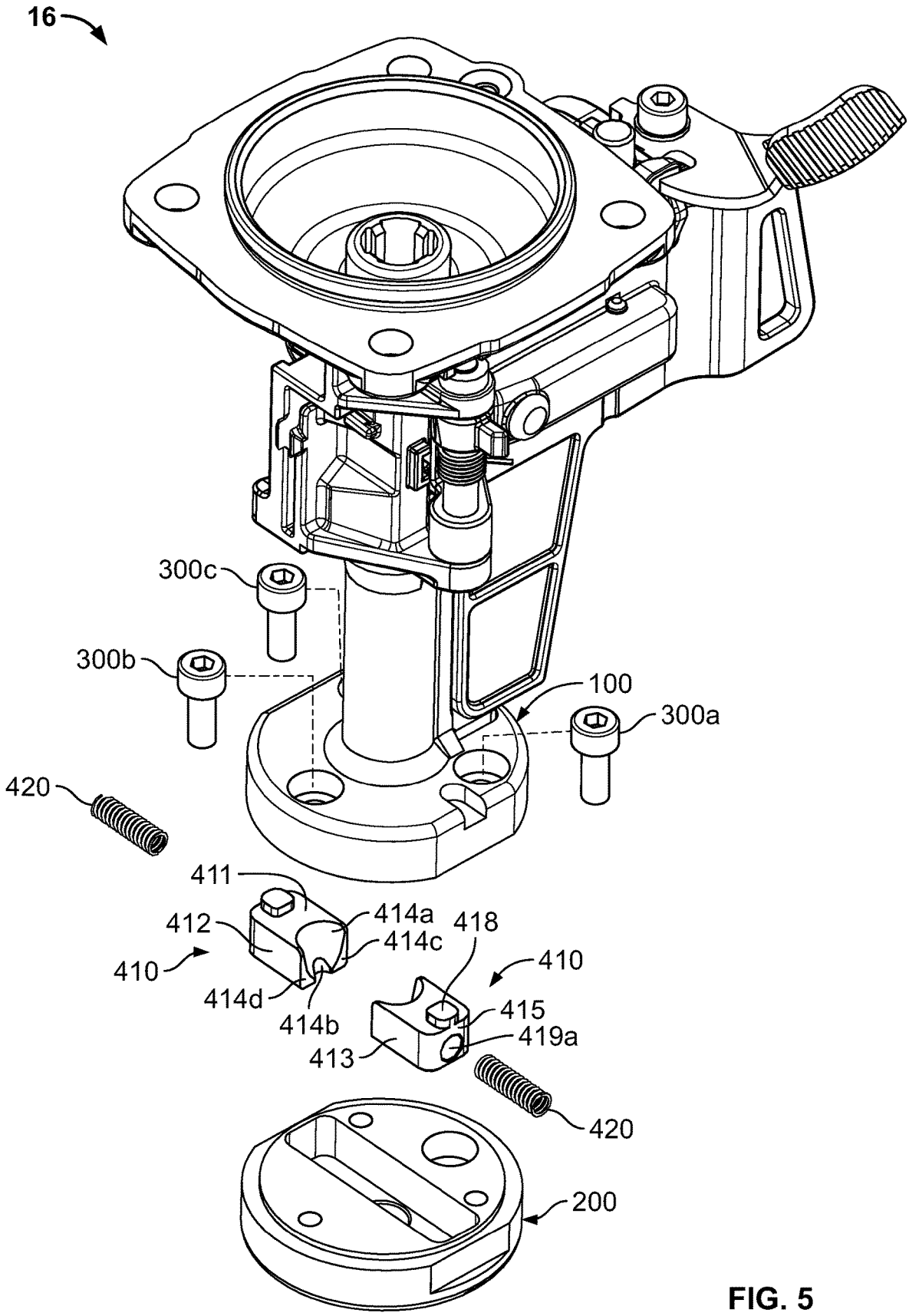
FIG. 5 is a partially exploded perspective view of the nosepiece, the workpiece-contact element, and the fastener-stabilizing assembly of FIG. 3.
Figure 7:
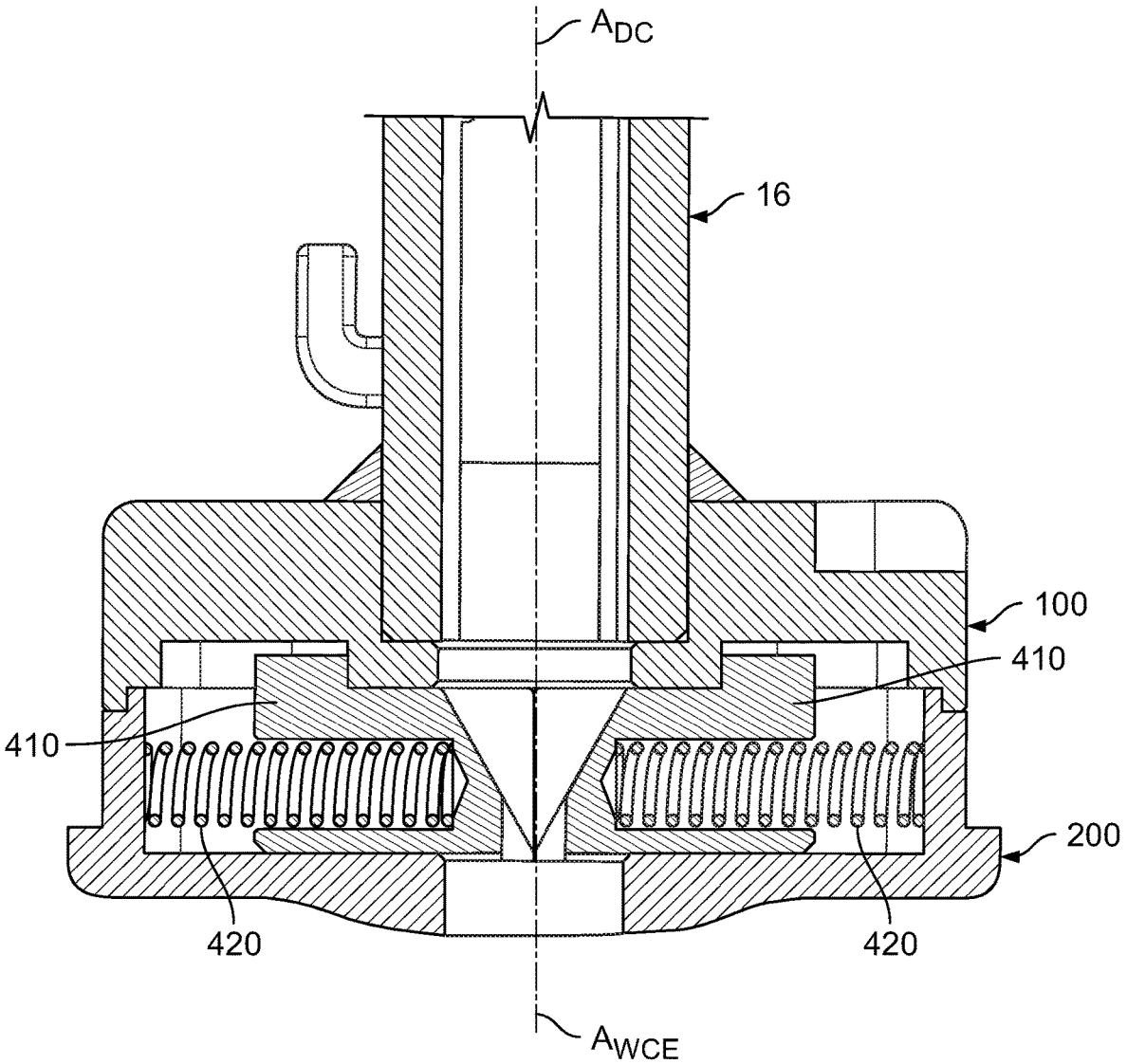
FIG. 7 is a fragmentary cross-sectional-front-side-elevational view of the assembled nozzle, fastener-stabilizing assembly, and workpiece-contact element of FIGS. 2-5 taken substantially along line 6G-6G of FIG. 6C.

As best shown in FIGS. 5 and 7, the fastener-stabilizing assembly 400 includes two identical fastener stabilizers 410 and two identical compression springs 420. Each fastener stabilizer 410 includes: (1) a flat (or in other embodiments at least partially curved) upper surface 411; (2) a flat (or in other embodiments at least partially curved) lower surface (not shown) opposing the upper surface 411; (3) a flat (or in other embodiments at least partially curved) first side surface 412; (4) a flat (or in other embodiments at least partially curved) opposing second side surface 413; (5) a front surface including a semi-frustoconical section 414*a*, a semi-cylindrical section 414*b*, and two flat (or in other embodiments at least partially curved) sections 414*c* and 414*d*; and (6) a flat (or in other embodiments at least partially curved) back surface 415 opposing the front surface. The fastener stabilizer 410 includes a locating tab 418 extending from the upper surface 411. The fastener stabilizer 410 includes a cylindrical surface 419*a* and an angled bottom surface 419*b* that together define a spring-receiving opening sized to receive part of the spring 420.

The fastener-stabilizing assembly 400 is installed in the fastener-stabilizing-receiving cavity defined in the workpiece-contact element 200 before mounting the workpiece-contact element 200 to the workpiece-contact mount 100 of the nosepiece 16. To do so, the springs 420 are inserted into the respective spring-receiving openings of the fastener stabilizers 410. The fastener stabilizers 410 with the springs 420 are then inserted into the fastener-stabilizing-receiving cavity such that. As best shown in FIG. 7, after installation the free ends of the springs 420 abut the short sections of the fastener-stabilizing-assembly-receiving-cavity side wall 212*a*, and the springs 420 are slightly compressed so they bias their respective fastener stabilizers 410 to the center of the fastener-stabilizing-receiving cavity such that the flat sections 414*c* and 414*d* of the front surfaces of the fastener stabilizers 410 contact one another.

After the fastener-stabilizing assembly 400 is installed, the workpiece-contact element 200 is attached to the workpiece-contact mount 100 of the nosepiece 16 via three fasteners 300*a*, 300*b*, and 300*c* respectively passed through bores formed in the workpiece-contact mount 100 and threadably received in the fastener-receiving openings of the workpiece-contact element 200. As best shown in FIG. 7, once the workpiece-contact element 200 is attached to the workpiece-contact mount 100, the locating tabs 418 of the fastener stabilizers 410 are received in corresponding locating cavities (not labeled) formed in the underside of the workpiece-contact mount 100. As best shown in FIG. 8, once the workpiece-contact element 200 is attached to the workpiece-contact mount 100, the head of the fastener 112 that secures the fastener-directing element 110 to the workpiece-contact mount 100 is received in the fastener-head-receiving opening.

FIGS. 9A-9D show the bottom of the nosepiece 16 and the workpiece-contact element 200 at different stages of a fastener-driving cycle when attaching gypsum board 1000 to lumber 2000.

Figure 9A:
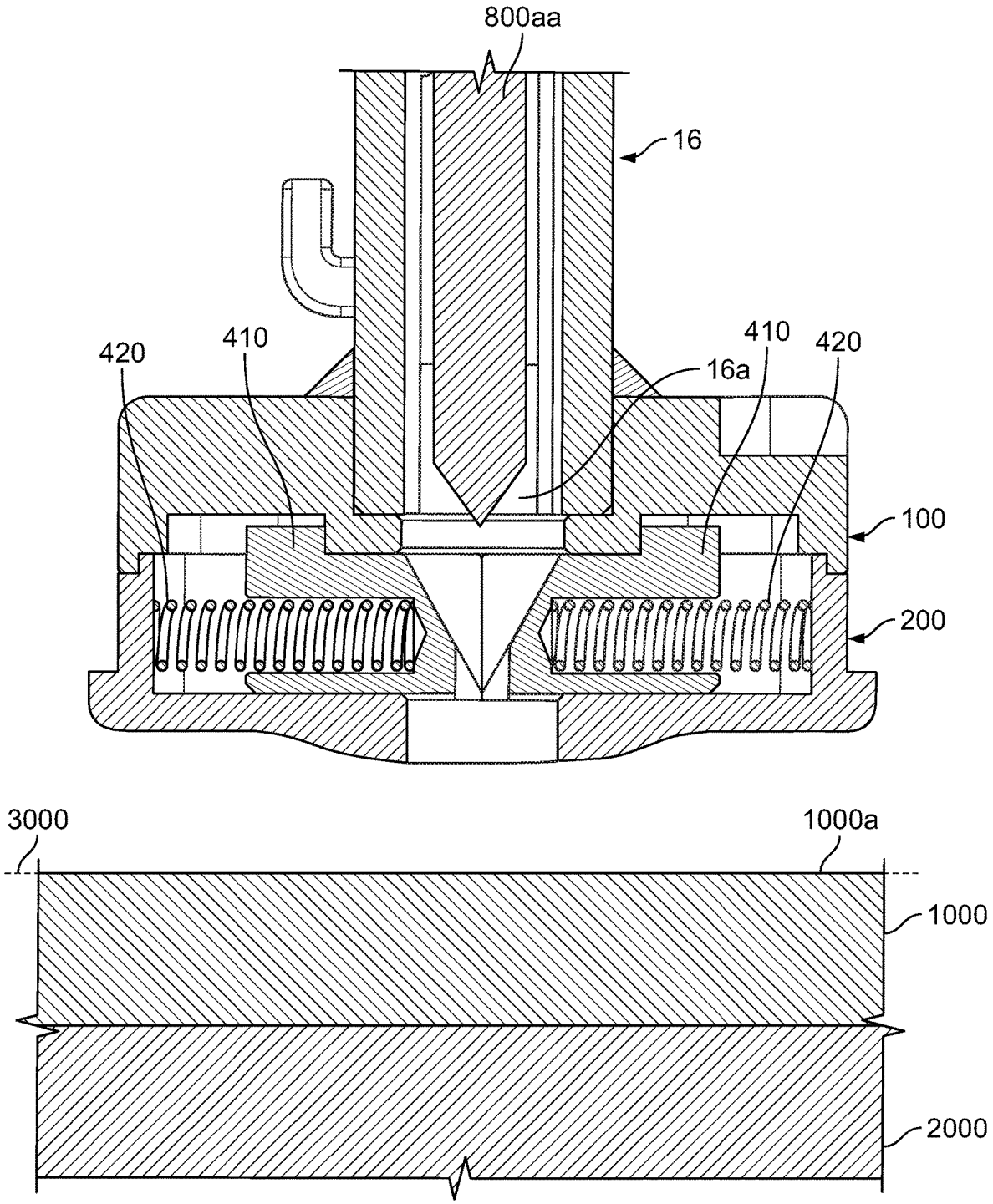
FIG. 9A is a fragmentary cross-sectional-front-side-elevational view, taken substantially along line 6G-6G of FIG. 6C, of the assembled nozzle, fastener-stabilizing assembly, and workpiece-contact element of FIGS. 2-5 preparing to drive a fastener to attach gypsum board to lumber.

In FIG. 9A, a fastener 800*aa* is positioned within the drive channel 16*a* and the workpiece-contact element 200 is spaced apart from the gypsum board 1000. The exterior surface 1000*a* of this portion of the gypsum board 1000 lies in the exterior plane 3000.

Figure 9B:
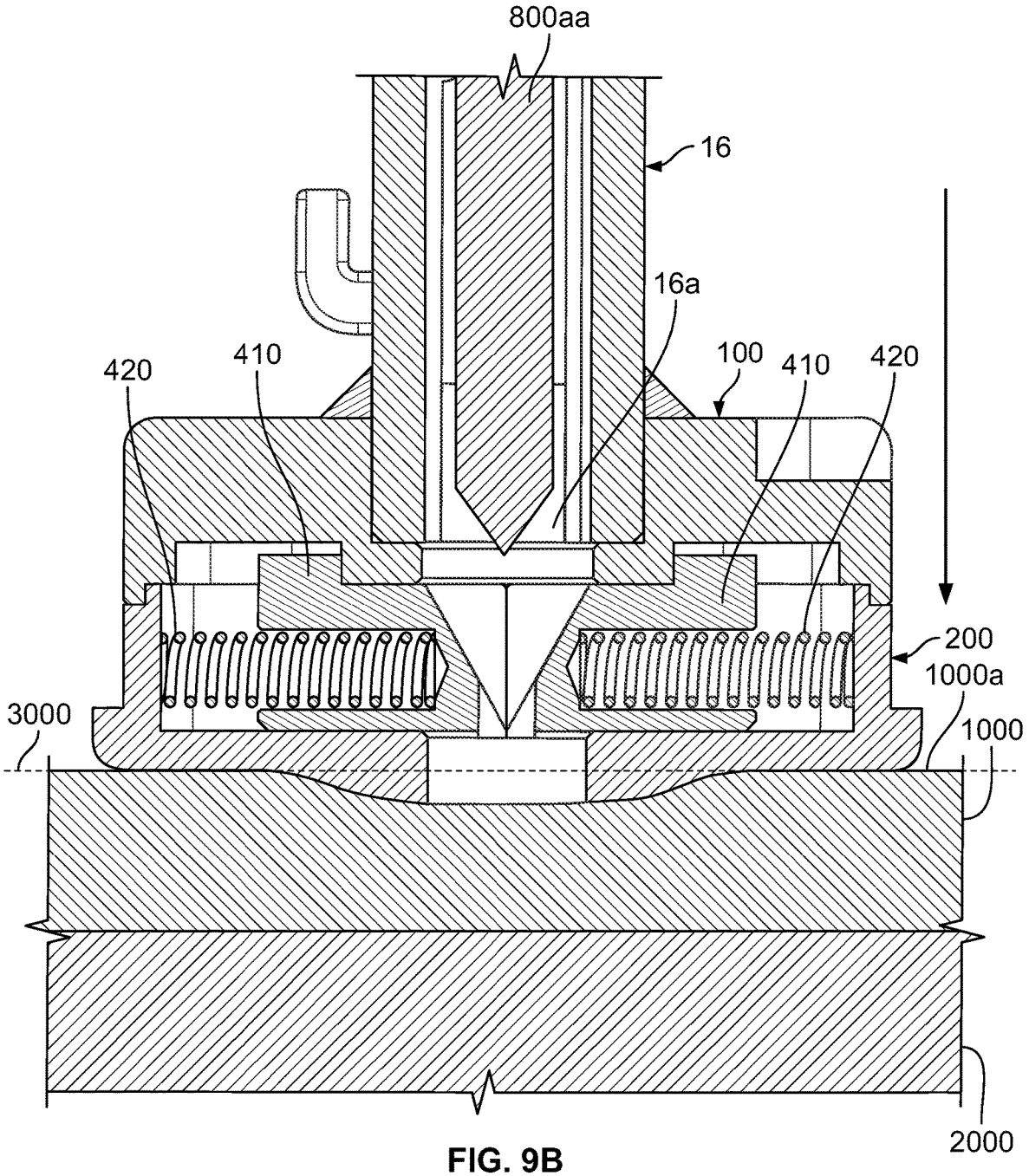
FIG. 9B is a fragmentary cross-sectional-front-side-elevational view, taken substantially along line 6G-6G of FIG. 6C, of the assembled nozzle, fastener-stabilizing assembly, and workpiece-contact element of FIG. 9A after the workpiece-contact element forms a depressed area in the exterior surface of the gypsum board.

In FIG. 9B, the head 14 has moved from the resting position to the driving position. This causes the workpiece-contact surface 210 of the workpiece-contact element 200 to contact the exterior surface 1000*a* of the gypsum board 1000 with enough force to clamp the gypsum board 100 and the lumber 200 between the workpiece-contact element 200 and the surface on which the lumber 200 is resting (not shown). This force combined with the protrusion formed by the workpiece-contact surface 210 causes the workpiece-contact element 200 to form a depressed area in the exterior surface 1000*a* of the gypsum board 1000. The bottom of the depressed area is below (i.e., recessed into the gypsum board relative to) the exterior plane 3000.

Figure 9C:
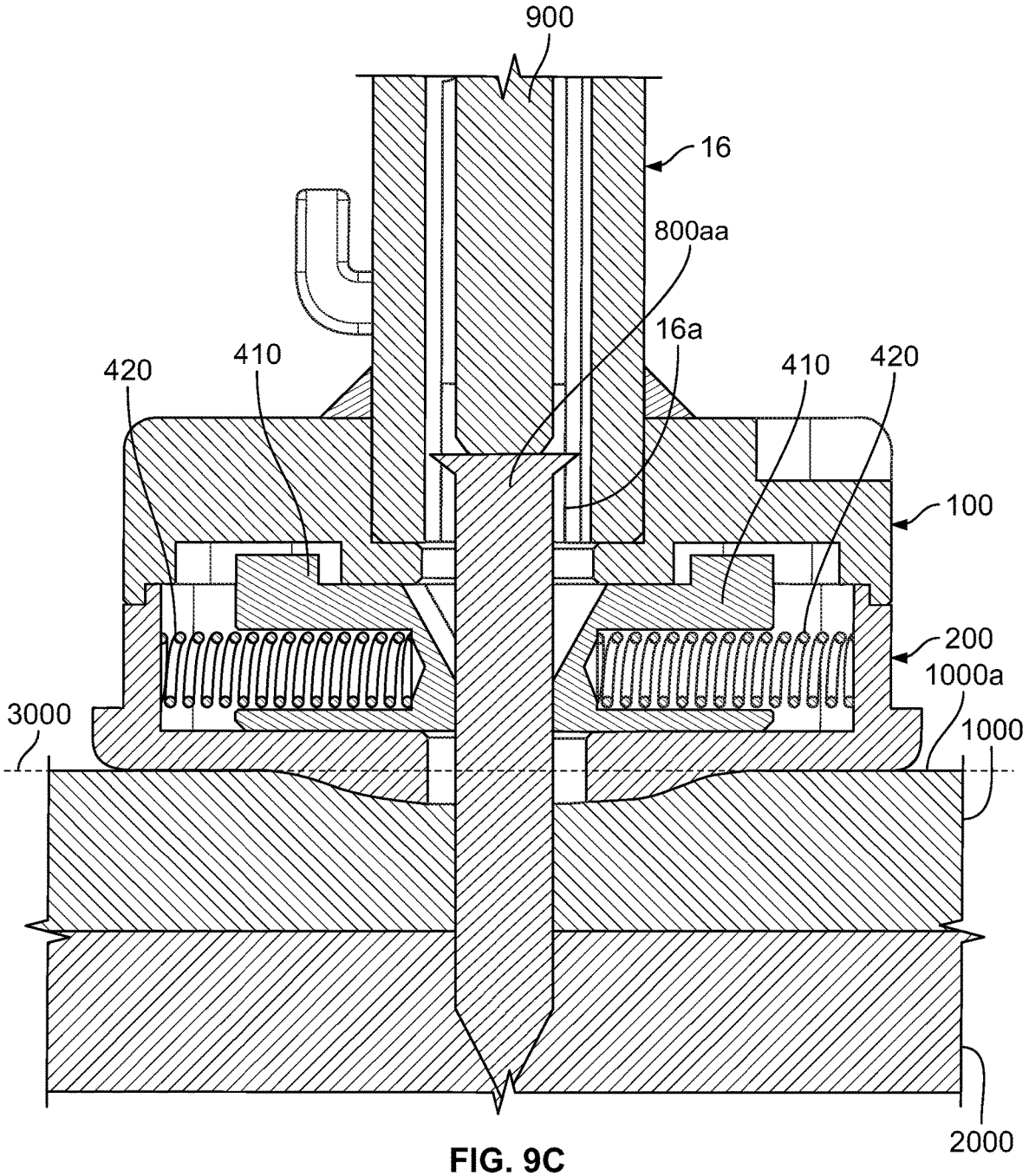
FIG. 9C is a fragmentary cross-sectional-front-side-elevational view, taken substantially along line 6G-6G of FIG. 6C, of the assembled nozzle, fastener-stabilizing assembly, and workpiece-contact element of FIG. 9A as the driver blade drives the fastener into the gypsum board and the lumber.

In FIG. 9C, a driver blade 900 is in the process of driving the fastener 800*aa* from the drive channel 16*a* and through the fastener-exit throughbore into the gypsum board 1000 and the lumber 2000. As the fastener 800*aa* enters the fastener-stabilizing assembly 400, the fastener 800*aa* overcomes the biasing force of the springs 420 and moves the fastener stabilizers 410 radially outward (compressing the springs 420) to accommodate the diameter of the fastener 800*aa*. The semicylindrical sections 414*b* of the front surfaces of the fastener stabilizers 410 contact and stabilize the fastener 800*aa* (via the biasing force of the springs 420) as it moves through the fastener-stabilizing assembly 400. This ensures that the longitudinal axis of the fastener 800*aa* remains generally aligned with the longitudinal axis $A_{DC}$ of the drive channel 16*a* and the longitudinal axis $A_{WCE}$ of the workpiece-contact element 200 as the fastener 800*aa* moves through the workpiece-contact element 200. If the longitudinal axis of the fastener 800*aa* is not coaxial with the longitudinal axes $A_{DC}$ and $A_{WCE}$ upon reaching the fastener-stabilizing assembly 400, the fastener tip will contact the semi-frustoconical surface of one of the fastener stabilizers 410. The angle of the semi-frustoconical surface will guide the tip back into proper alignment with the longitudinal axes $A_{DC}$ and $A_{WCE}$ to properly align it.

Figure 9D:
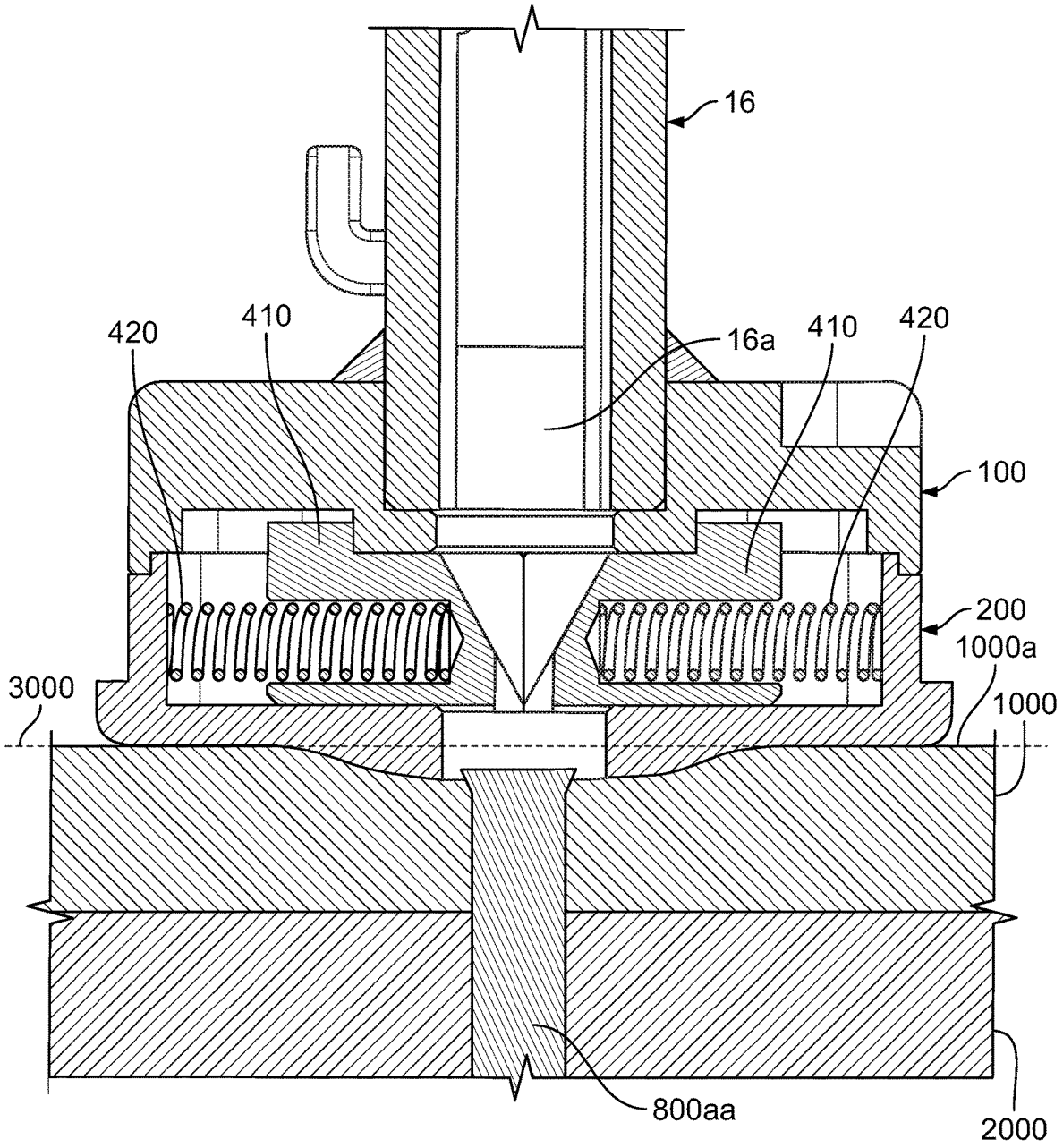
FIG. 9D is a fragmentary cross-sectional-front-side-elevational view, taken substantially along line 6G-6G of FIG. 6C, of the assembled nozzle, fastener-stabilizing assembly, and workpiece-contact element of FIG. 9A after the fastener has been driven into the gypsum board and the lumber.

In FIG. 9D, the driver blade has driven the fastener 800*aa* into the gypsum board 1000 and the lumber 2000. Since the fastener 800*aa* has exited the nosepiece 16 and the workpiece-contact element 200, the springs 420 bias the fastener stabilizers 410 back to their rest positions. The fastener head protrudes just above the exterior surface 1000*a* of the depressed area of the gypsum board 1000. Since the fastener 800*aa* is positioned within the depressed area, the fastener head is recessed relative to the exterior plane 3000.

The workpiece-contact element solves the above-described problems by providing a fastener pusher that consistently recesses fastener heads without damaging the gypsum board. The annular protrusion of the workpiece-contact element creates a depression in the gypsum board during fastener driving. The bottom of this depression is below the exterior plane formed by the exterior surface of the non-depressed areas of the gypsum board. This means that the fastener head can protrude from the exterior surface of the depressed area of the gypsum board and still be recessed below the exterior plane. The fastener pusher can therefore use relatively low-pressure air to drive the driving element and consistently recess fastener heads relative to the exterior plane while minimizing damage to the gypsum board.

The use of a removable workpiece-contact element is also beneficial. The workpiece-contact element, and particularly the protrusion formed by the workpiece-contact surface, may become worn after extensive use, which reduces its effectiveness. When this happens, all an operator needs to do is remove three screws to swap the worn workpiece-contact element with a new workpiece-contact element.

In the illustrated embodiments described above, the profile of the protrusion when viewed from the bottom (i.e., FIG. 6D) is circular. In other embodiments, the outer profile of the protrusion when viewed from the bottom is protrusion is annular. In other embodiments, the outer profile of the protrusion when viewed from the bottom is protrusion is oval. In other embodiments, the outer profile of the protrusion when viewed from the bottom is protrusion is rectangular. These are merely examples, and the outer profile of the protrusion when viewed from the bottom may take any suitable shape.

In certain embodiments, the workpiece-contact element is integrally formed with the nosepiece and not a separate component removably attached to the nosepiece.

While the above-described example tool is a pneumatic-powered fastener pusher, the features described above can apply to other types of powered-fastener-driving tools.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention claimed is:

1. A workpiece-contact element comprising:

an attachment side having one or more fastener-stabilizing-assembly-receiving cavity surfaces directly connected to a surface of the attachment side and defining a fastener-stabilizing-assembly-receiving cavity;

a workpiece-contact surface;

an outer cylindrical side surface; and one or more fastener-exit surfaces defining a fastener-exit throughbore having a longitudinal axis and extending through the workpiece-contact surface, wherein the workpiece-contact surface forms a protrusion extending away from the attachment side, wherein the workpiece-contact surface is formed between the one or more fastener-exit surfaces defining the fastener-exit throughbore and the outer cylindrical side surface, wherein the workpiece-contact surface radiates outwardly from the fastener-exit throughbore to the outer cylindrical side surface, the workpiece-contact surface comprising:

(a) a first at least partially annular flat section transverse to the longitudinal axis and having a first height from the attachment side, (b) a second at least partially annular flat section transverse to the longitudinal axis and having a second height from the attachment side, said second height being greater than the first height, and (c) a third at least partially annular section directly connecting the first flat section and the second flat section and extending away from the first flat section toward the longitudinal axis, wherein the second section, the third section, and the first section are directly connected in a linear progression extending away from the fastener-exit throughbore and ending at the outer cylindrical side surface.

2. The workpiece-contact element of claim 1, wherein the protrusion is centered on the longitudinal axis.

3. The workpiece-contact element of claim 1, wherein the first and second sections are perpendicular to the longitudinal axis.

4. The workpiece-contact element of claim 1, wherein the third section includes an at least partially annular concave portion connected to the first section and that transitions into an at least partially annular convex portion.

5. A workpiece-contact assembly comprising:

a workpiece-contact element mount mountable on a nosepiece of a fastener pusher, wherein the nosepiece defines a drive channel around a longitudinal axis of the nosepiece, and wherein the workpiece-contact element mount comprises an outer cylindrical rim centered on the longitudinal axis;

a workpiece-contact element detachably mountable to the workpiece-contact element mount, the workpiece-contact element comprising:

an attachment side comprising a cylindrical standoff centered on the longitudinal axis, the cylindrical standoff configured to mate with the outer cylindrical rim;

a workpiece-contact surface opposite the attachment side;

one or more fastener-stabilizing-assembly-receiving cavity surfaces directly connected to a surface of the attachment side and defining a fastener-stabilizing-assembly-receiving cavity; and one or more fastener-exit surfaces defining a fastener-exit throughbore about the longitudinal axis and extending through the workpiece-contact surface, wherein the workpiece-contact surface forms a protrusion extending away from the attachment side; and a fastener-stabilizing assembly positionable within the fastener-stabilizing-assembly-receiving cavity.

6. The workpiece-contact assembly of claim 5, wherein the protrusion is centered on the longitudinal axis.

7. The workpiece-contact element of claim 6, wherein the protrusion is at least partially annular.

8. The workpiece-contact assembly of claim 7, wherein the workpiece-contact surface comprises a flat first at least partially annular section transverse to the longitudinal axis and a second at least partially annular section connected to the first annular section and extending from the first section toward the longitudinal axis and away from the workpiece-contact surface.

9. The workpiece-contact assembly of claim 8, wherein the workpiece-contact surface further comprises a third at least partially annular section connected to the second section and transverse to the longitudinal axis.

10. The workpiece-contact assembly of claim 9, wherein the first and third sections are perpendicular to the longitudinal axis.

11. The workpiece-contact assembly of claim 8, wherein the second section includes a concave portion connected to the first annular section and that transitions into a convex portion.

12. The workpiece-contact assembly of claim 5, wherein the fastener-stabilizing assembly includes two fastener stabilizers and two corresponding biasing elements.

13. The workpiece-contact assembly of claim 12, wherein the fastener-stabilizing assembly is positionable within the fastener-stabilizing-assembly-receiving cavity such that the biasing elements bias the fastener stabilizers to contact one another.

14. The workpiece-contact assembly of claim 13, wherein the fastener stabilizers are shaped to form a frustoconical fastener guiding surface centered on the longitudinal axis when biased to contact one another.

15. A fastener pusher comprising:

a body;

a head supported by and movable relative to the body between a rest position and a driving position;

a nosepiece attached to the head, the nosepiece defining a drive channel around a longitudinal axis of the nosepiece;

a workpiece-contact element mount attached to the nosepiece, the workpiece-contact element mount comprising an outer cylindrical rim centered on the longitudinal axis; and a workpiece-contact element detachably mounted to the workpiece-contact element mount, the workpiece-contact element comprising:

an attachment side comprising a cylindrical standoff centered on the longitudinal axis, the cylindrical standoff configured to mate with the outer cylindrical rim;

a workpiece-contact surface opposite the attachment side;

a bottom surface, two spaced apart opposing end surfaces, and two spaced apart opposing side surfaces on the attachment side and that define a fastener-stabilizing-assembly-receiving cavity configured to receive a fastener-stabilizing assembly from the attachment side; and one or more fastener-exit surfaces defining a fastener-exit throughbore about the longitudinal axis and extending through the workpiece-contact surface, wherein the workpiece-contact surface forms a protrusion extending away from the attachment side; and a fastener-stabilizing assembly positionable within the fastener-stabilizing-assembly-receiving cavity.

16. The fastener pusher of claim 15, wherein the nosepiece includes one or more drive channel surfaces that define a drive channel having a longitudinal axis, wherein the longitudinal axes of the drive channel and the fastener-exit throughbore are coaxial.

17. The fastener pusher of claim 16, wherein the nosepiece defines a fastener-receiving channel having a longitudinal axis transverse to the longitudinal axis of the drive channel.

18. The fastener pusher of claim 15, wherein the fastener-stabilizing assembly includes two fastener stabilizers and two corresponding biasing elements configured to move within the fastener-stabilizing-assembly-receiving cavity.

19. The fastener pusher of claim 18, wherein the workpiece-contact element mount defines two separate cavities, and wherein the two fastener stabilizers each comprise a standoff that is configured to move within a respective one of the two cavities.

* * * * *